US009245461B1

(12) United States Patent
Shlonsky

(10) Patent No.: US 9,245,461 B1
(45) Date of Patent: Jan. 26, 2016

(54) GREETING CARD WITH POP-OUT AND AUDIO

(71) Applicant: American Greetings Corporation, Cleveland, OH (US)

(72) Inventor: Lynne Shlonsky, Shaker Heights, OH (US)

(73) Assignee: American Greetings Corporation, Cleveland, OH (US)

( * ) Notice: Subject to any disclaimer, the term of this patent is extended or adjusted under 35 U.S.C. 154(b) by 0 days.

(21) Appl. No.: 14/832,012

(22) Filed: Aug. 21, 2015

Related U.S. Application Data

(60) Provisional application No. 62/041,791, filed on Aug. 26, 2014.

(51) Int. Cl.
*G09F 1/06* (2006.01)
*B42D 15/02* (2006.01)

(52) U.S. Cl.
CPC ..... *G09F 1/06* (2013.01); *B42D 15/022* (2013.01)

(58) Field of Classification Search
CPC ..... G09F 1/06; B42D 15/022; B42D 15/045
See application file for complete search history.

(56) References Cited

U.S. PATENT DOCUMENTS

| | | | | | |
|---|---|---|---|---|---|
| 2,891,336 | A * | 6/1959 | Sellmer | G09F 1/06 | 40/124.14 |
| 3,057,095 | A * | 10/1962 | Foreman | G09F 1/06 | 40/800 |
| 5,055,084 | A | 10/1991 | Jokic | | |
| 5,259,133 | A * | 11/1993 | Burtch | B42D 15/045 | 40/124.08 |
| 5,261,172 | A * | 11/1993 | Rowley | G09F 1/08 | 40/124.08 |
| 5,450,680 | A | 9/1995 | Bromberg | | |
| 7,634,864 | B2 * | 12/2009 | Segan | B42D 15/045 | 40/124.03 |
| 8,418,384 | B2 | 4/2013 | Jin et al. | | |
| 8,726,548 | B2 * | 5/2014 | Larson | B42D 15/022 | 273/108.1 |
| 8,739,438 | B1 * | 6/2014 | Deckerd | B42D 15/022 | 40/124.02 |
| 9,027,269 | B2 * | 5/2015 | Budzar | B42D 15/027 | 40/124.03 |
| 2012/0055053 | A1 * | 3/2012 | Guo | B42D 15/022 | 40/124.03 |
| 2013/0097899 | A1 * | 4/2013 | Budzar | G09F 1/06 | 40/124.03 |

* cited by examiner

*Primary Examiner* — Gary Hoge
(74) *Attorney, Agent, or Firm* — Christine Flanagan

(57) ABSTRACT

An interactive greeting card which operates as a faux cuckoo clock. The greeting card contains an opening thereon beneath which is a pop-out character. One or more moveable flaps cover the opening and conceal the pop-out character. A pull tab mechanism is used to open one or more moveable flaps and set forth the pop-out character. The pull tab mechanism may also initiate playback of one or more pre-recorded audio files stored on a memory device within the greeting card.

17 Claims, 6 Drawing Sheets

GREETING CARD WITH POP-OUT AND AUDIO

RELATED APPLICATIONS

This application claims priority to U.S. Provisional Patent Application No. 62/041,791, filed on Aug. 26, 2014, a copy of which is incorporated herein in its entirety by reference.

FIELD OF THE INVENTION

The present invention is in the field of greeting cards and social expression products, and is directed to an interactive greeting card.

SUMMARY OF THE INVENTION

An interactive greeting card which operates as a faux cuckoo clock. The greeting card contains an opening thereon beneath which is a pop-out character. One or more moveable flaps cover the opening and conceal the pop-out character. A pull tab mechanism is used to open the one or more moveable flaps and set forth the pop-out character. The pull tab mechanism may also initiate playback of one or more pre-recorded audio files stored on a memory device within the greeting card.

DETAILED DESCRIPTION OF PREFERRED AND ALTERNATE EMBODIMENTS

The greeting card of the present invention is directed to an interactive greeting card which imitates a faux cuckoo clock having pop-out character and sound capabilities. The greeting card contains a small pull-tab which causes a small character to emerge from a window or inset on the front face of the greeting card while pre-recorded audio is emitted through a speaker.

The greeting card body is preferably made of paperboard but other similar, lightweight materials can be used. The greeting card may contain multiple main panels attached along various fold lines. The main panels may cover or conceal the electronic components of the greeting card and may be fitted around a protective structure such as a frame made of cardboard or foam which surrounds the electronic components. The internal structure defines the perimeter thickness of the greeting card, which includes right, left, upper and lower perimeter panels. A sentiment panel 11 may be attached to the rear surface of the wrapped frame structure along a fold line. The sentiment panel 11 provides a more traditional greeting card look, by providing a panel that can open and close and which provides space for a user to sign his/her name or write a personal message. Each of the greeting card panels may contain text sentiment, photographs, drawings, artwork, or other printing thereon. Additional embellishments may also be attached to one or more greeting card panels.

Figure 1:
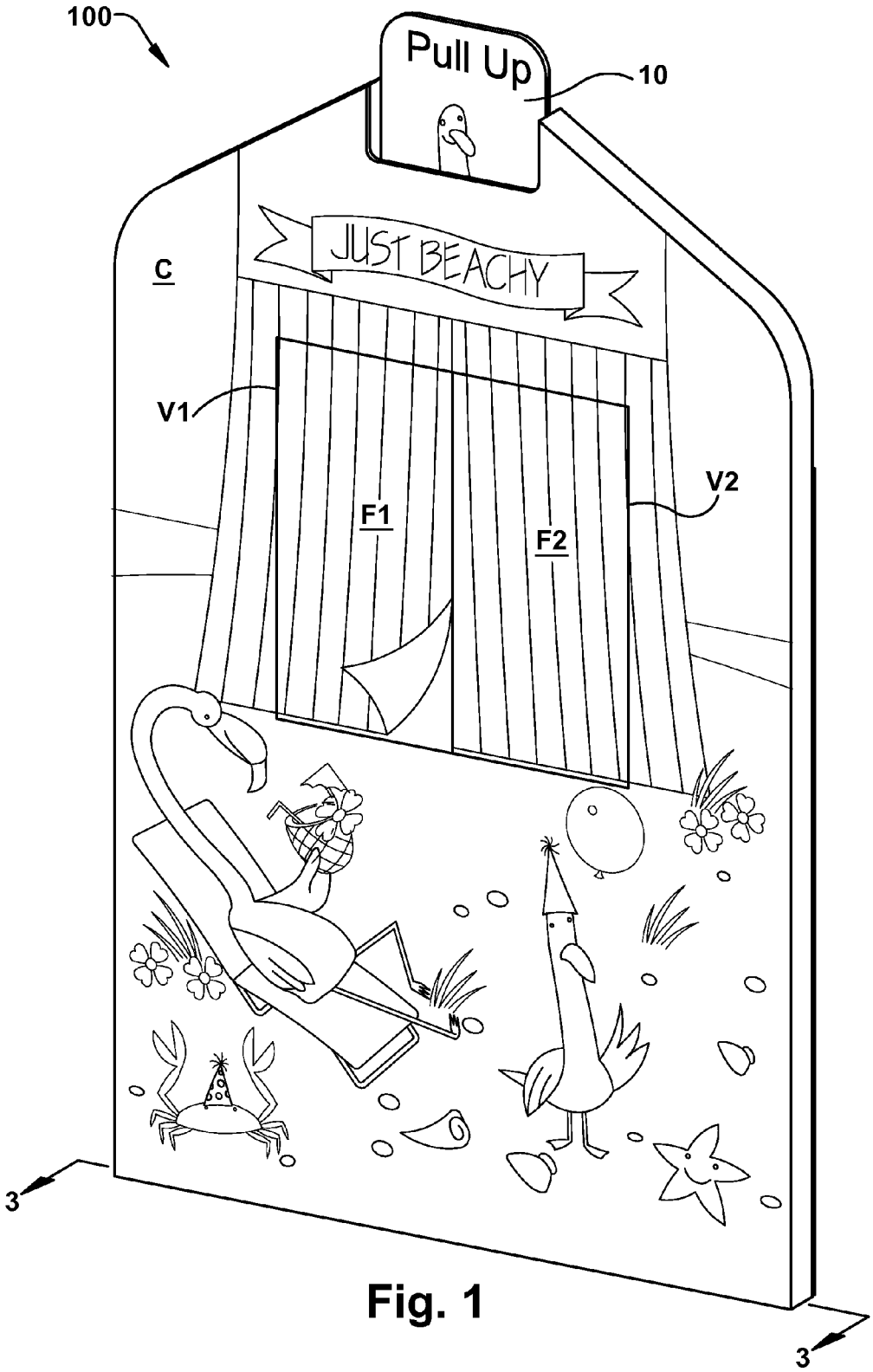
FIG. 1 is a perspective view of the greeting card of the present invention, with closed flaps.
Figure 2:
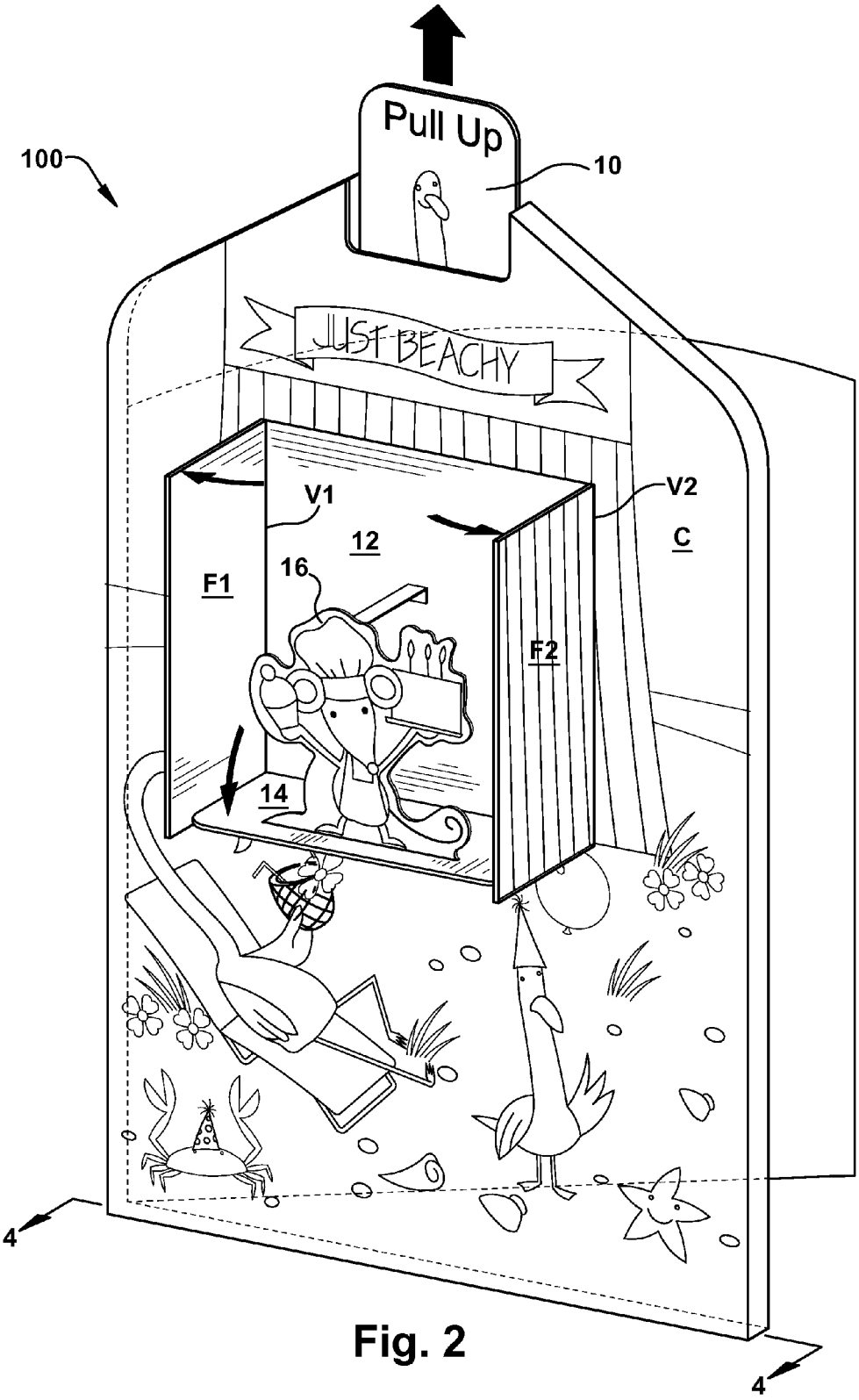
FIG. 2 is a perspective view of the greeting card of FIG. 1, with open flaps.

At least one greeting card panel, preferably the front cover panel C, contains two flap panels F1, F2 which are connected to and contiguous with the front cover card panel C (or other greeting card panel) but which are capable of moving or pivoting about two separate fold lines V1, V2 to reveal a pop-out display P therebeneath. The flaps F1, F2 open in opposing directions from each other, similar to French doors. A pull tab mechanism 10 controls opening and closing the flaps F1, F2 and the partial removal and re-insertion of the pop-out display P from the greeting card 100. The pull tab 10, in a preferred embodiment, is located at the top perimeter (or upper perimeter panel) of the greeting card 100. It is partially inserted into the body of the greeting card 100 with a portion remaining visible above the top edge of the greeting card 100. The pull tab 10 can be moved from a first position wherein it is partially contained within the greeting card body 100 (though still visible), as shown in FIGS. 1, 3, 5 and 7, and a second position wherein it is further outside of the greeting card body 100 (and further visible), as shown in FIGS. 2, 4, 6 and 8. Gripping the pull tab 10 between a thumb and index finger and pulling in an upward direction moves the pull tab 10 from the first position to the second position and causes the two flaps F1, F2 on the front greeting card panel C to open, revealing the pop-out P display thereunder. Moving the pull tab 10 from the first to second position also causes the pop-out display P to move from a first position wherein it is contained within the greeting card body 100 (and behind the two flaps), as shown in FIG. 1, to a second position wherein it extends outward (in a horizontal direction) from behind the two flap panels F1, F2 and outside of the greeting card body 100, as shown in FIG. 2, similar to a cuckoo bird emerging from a clock or other enclosure. Pulling upward on the pull tab 10 also triggers replay of at least one pre-recorded audio file. Once the pull tab 10 has been pulled in an upward direction, and moved from the first to second position, it remains in the second position, as does the pop-out display 10 until further manual interaction from the user. The pull tab 10 must be manually inserted back into the greeting card 100 or moved from the second position back to the first position, in order for the pop-out display P to recede back into the greeting card body 100, for the flap panels F1, F2 to close, and for the audio to cease (audio playback will also cease, even if the pull tab 10 remains in the second position, when a pre-determined time limit has been exhausted or the audio file has reached its end). The pull tab 10 can be repeatedly moved between the first and second positions.

Figure 3:
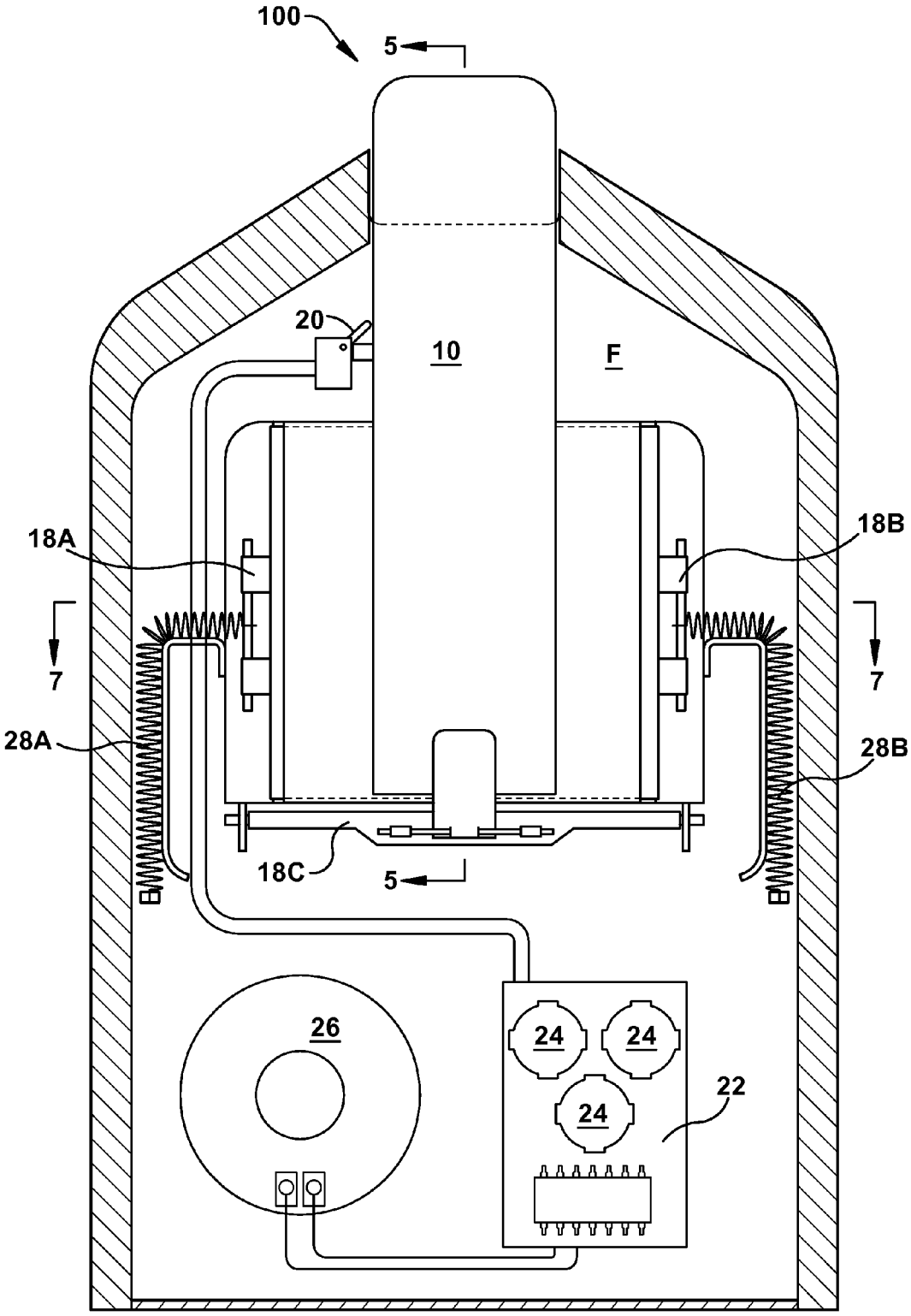
FIG. 3 is a front internal view greeting card of FIG. 1, from the direction of arrows 3-3.
Figure 4:
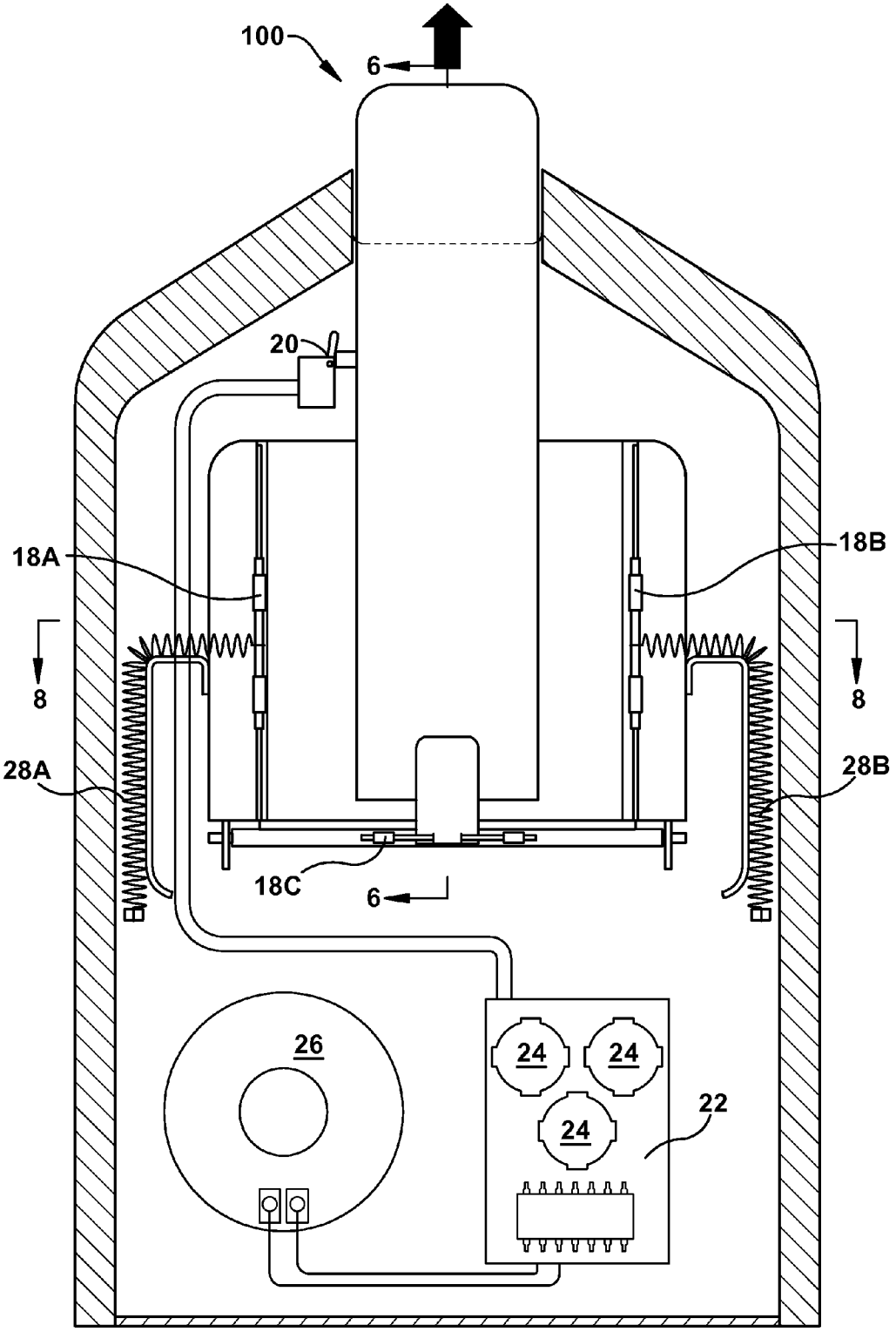
FIG. 4 is a front internal view of the greeting card of FIG. 2, from the direction of arrows 4-4.
Figure 5:
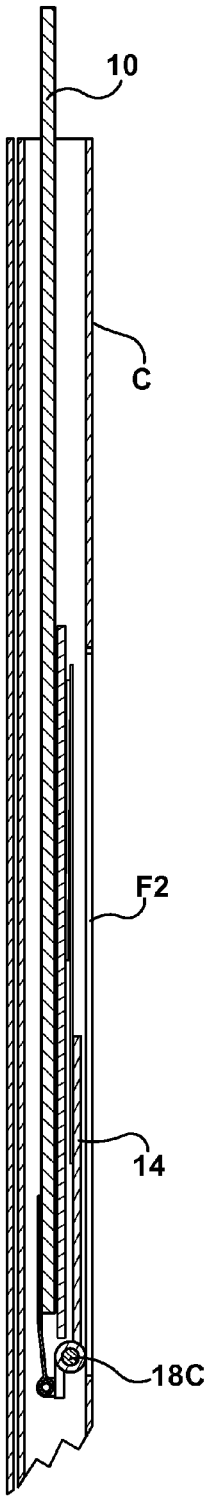
FIG. 5 is a cross-sectional view of the greeting card of FIG. 3, from the direction of arrows 5-5.
Figure 6:
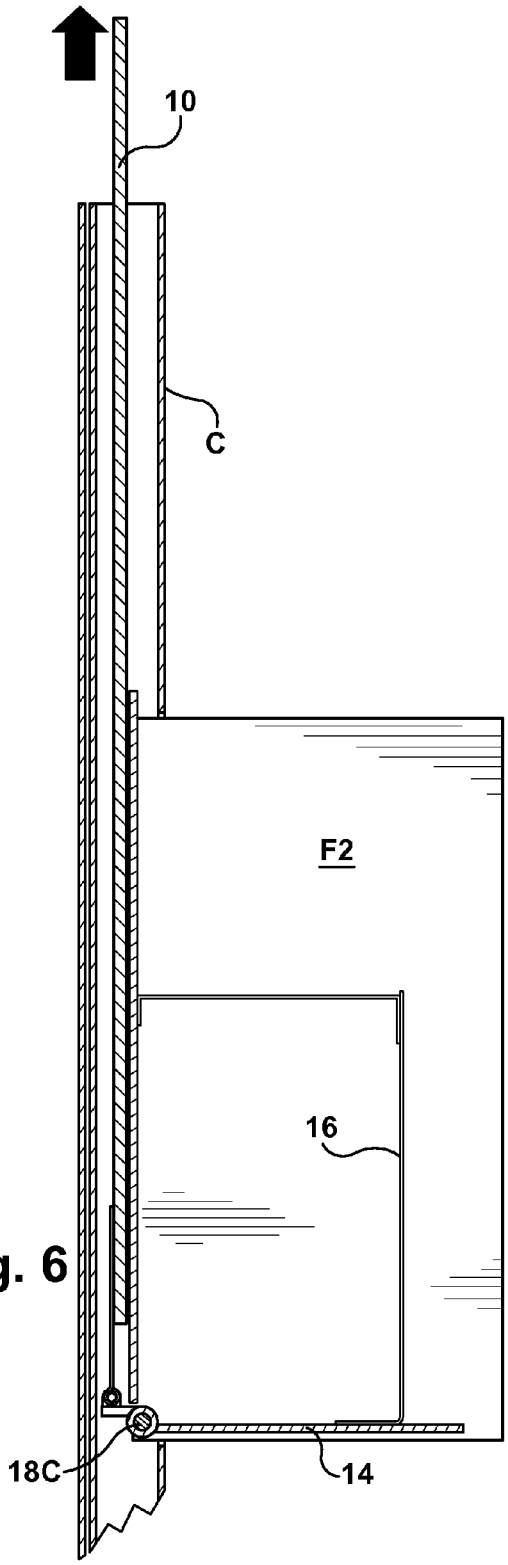
FIG. 6 is a cross-sectional view of the greeting card of FIG. 4, from the direction of arrows 6-6.
Figure 7:
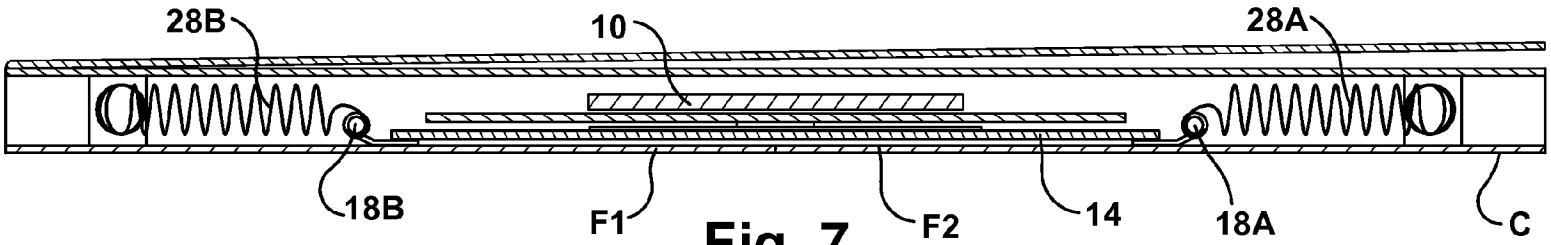
FIG. 7 is cross-sectional view of the greeting card of FIG. 3, from the direction of arrows 7-7.
Figure 8:
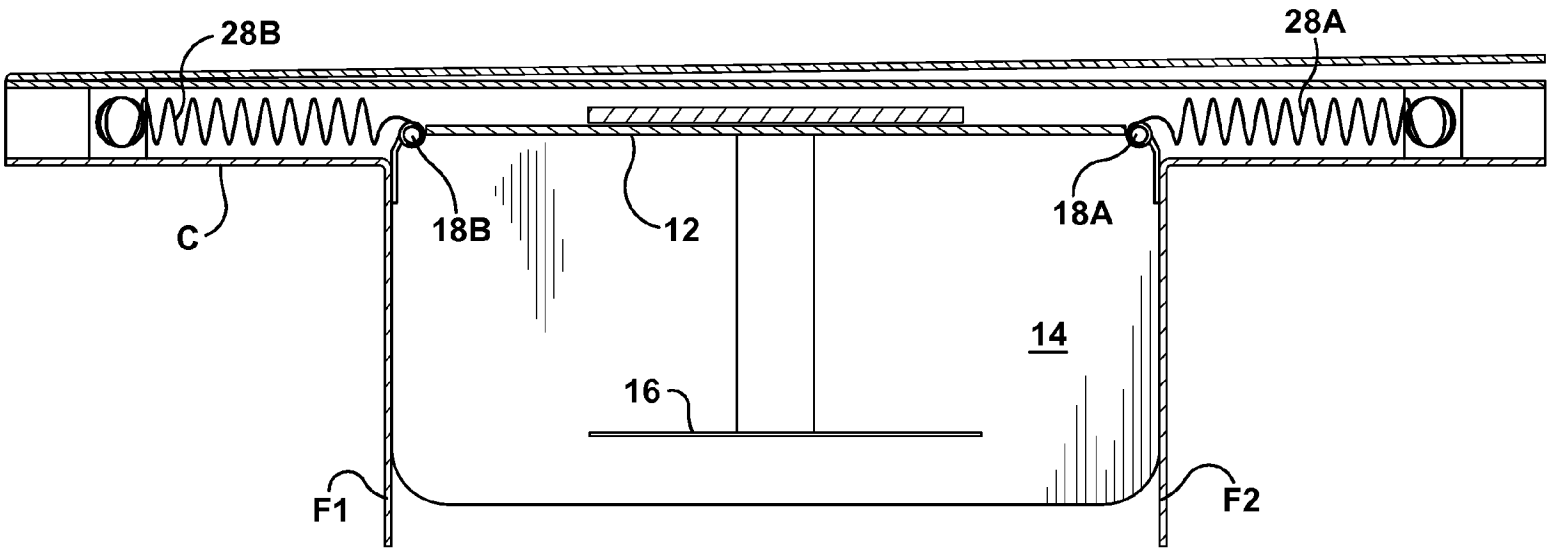
FIG. 8 is a cross-sectional view of the greeting card of FIG. 4 from the direction of arrows 8-8.

The pop-out display P, in a preferred embodiment, is attached to a frame structure F which, in connection with the pull-tab mechanism 10, controls movement of the flaps F1, F2 and the pop-out display P. The frame F is contained beneath the front cover panel C within the greeting card body 100 and substantially surrounds the opening in the front cover panel C of the greeting card 100 (behind the two flaps F1, F2). The frame F may contain various segments which are independently moveable and which control the movement of various portions of the pop-out display structure P. The pop-out structure P includes a backer panel 12, a small ledge 14 which is operative to project downward and outward from a bottom edge of the frame F (and opening in the greeting card panel) and a die cut shape 16 which is attached to and extends upward from the ledge 14. The pull tab 10 is attached to at least one segment of the frame F such that when the pull tab 10 is pulled in an upward direction, it causes movement of the various segments of the frame F which effect movement of the pop-out display structure P, including the opening of the two flaps F1, F2 to reveal the pop-out display P and the small character 16 attached thereto. The ledge portion 14 of the pop-out display structure P is attached to a bottom or lower horizontal edge of the substantially square-shaped frame structure F. The backer panel 12, which may contain printing thereon depicting a background scene, is attached at a vertical edge to one vertical edge of the frame structure F and at an opposite vertical edge to an opposite vertical edge of the frame structure F. When the pull-tab 10 is pulled upward, movement mechanisms 18A, 18B attached to both side vertical edges of the frame F cause the backer panel 12 to pivot about two vertical fold lines V1, V2. The movement mechanism 18C, attached to the bottom edge of the frame F forces the ledge portion 14 of the pop-out display P from a first position wherein it is in a substantially vertical position (behind flaps F1, F2) to a second position wherein it is lowered into a substantially horizontal position, thereby forcing open the two flaps F1, F2 on the outside of the greeting card panel C and revealing the small character 14 attached thereto. The right and left side movement mechanisms 18A, 18B are each attached to a spring 28A, 28B which stretches when the two flaps F1, F2 are opened and retains the flaps F1, F2 in the outward or open position. When the two flaps F1, F2 are closed the springs 28A, 28B each return to their original unstretched position. There is also a small lever 20 contained near an upper portion of the pull tab mechanism 10 that is moved from a first position to a second position when a user pulls up on the pull tab mechanism 10, as shown in FIG. 4. This lever 20 controls activation of the sound module to replay at least one audio file through the speaker. The lever 20 is moved back to the first position from the second position when the pull tab mechanism 10 is pushed back down into the greeting card body 100, as shown in FIG. 3. The sound module may also cease to replay the audio file upon the audio file being played until completion. It is reset upon moving the pull-tab mechanism 10 back into the greeting card body 100 and again pulling up on the pull-tab mechanism 10.

The small character 16 attached to the pop-out display P, in a preferred embodiment, is a die cut shape. The pop-out character 16 can be shaped like an animal, a person, or any conceivable object. The pop-out character 16 can be complementary to the theme or design of the greeting card 100 and the associated greeting presented thereon. For example, the greeting card 100 may be shaped and printed to look like a birdhouse and the pop-out character 16 may be made to resemble a bird, such as a cuckoo bird within a clock. The pre-recorded audio may also be complementary to the theme of the greeting card 100. In the example set forth above with the birdhouse and cuckoo bird, the audio may include audio which mimics a cuckoo clock.

The electronic components of the greeting card may include a printed circuit board 22, integrated circuit, processor, memory device, power source 24, speaker 26, switch and any other component which is necessary for or which facilitates the storing and playback of audio. Additional components may be added, such as a motor module for effecting motion of the pop-out character, or a light module for controlling illumination of one or more lights within the greeting card. Various switch types may be used such as a slide switch, contact switch, motion sensor switch, touch sensor switch, light sensor switch, magnetic switch, and the like.

In operation, when a user pulls upward on the pull tab mechanism 10 (a portion of which is visible above the top edge of the greeting card body, as shown in FIG. 1) the two flaps F1, F2 on the front panel C of the greeting card 100 open outward in opposing directions and a pop-out display P (including small character 16) is pushed forward and outward from within the greeting card 100. Audio playback of at least one audio file is also initiated upon the user pull upward on the pull tab mechanism 10. The pull-tab mechanism 10 and the pop-out display P will stay in the same position until the user manually pushes the pull tab mechanism 10 back into the greeting card 100 causing the pop-out display P to recede back into the greeting card 100 and closing the two flaps F1, F2 or doors on the front panel C of the greeting card 100. The audio file will also cease playback upon pushing the pull tab mechanism 10 back into the greeting card 100 (or until the audio file has played for a pre-determined time limit).

While the greeting card of the present invention has been described herein and shown in the figures as being shaped a certain way and made of certain materials, the embodiments described herein are for illustrative purposes only and are not intended to limit the scope of the invention in any way. The number and arrangement of panels and the location of the flaps and pop-out structure are also described in a particular way but other number of panels and the location of the flaps and pop-out structure have been contemplated and are considered to be within the scope of the present invention. Also, the pull tab mechanism can be replaced by a different type of trigger mechanism, including, but not limited to: a push button, a lever, a crank, a slide lever, etc. Additionally, more than one trigger mechanism may be used to effect movement of the flaps, the pop-out structure and the replay of audio. Different methods of causing the ejection of the pop-out character may be used and a different underlying structure may be used as well, to open the flaps and move the pop-out character in a forward direction.

The invention claimed is:

1. A greeting card comprising:

a multi-panel greeting card body;

at least one flap contained on one panel of the multi-panel greeting card body;

a pop-out structure located beneath the at least one flap which is moveable between a first position wherein it is contained within the greeting card body and concealed behind the at least one flap, and a second position wherein it is contained outside of the greeting card body;

a pull tab mechanism which is moveable between a first position wherein a small portion of the pull-tab mechanism is contained outside of the greeting card, and a second position wherein a larger portion of the pull tab mechanism is contained outside of the greeting card;

wherein the moving the pull tab mechanism from the first position to the second position causes the pop-out structure to move between the first position and the second position; and wherein moving the pull tab mechanism from the second position back to the first position moves the pop-out structure from the second position back to the first position.

2. The greeting card of claim 1, wherein there pop-out structure contains a small die cut character attached thereto.

3. The greeting card of claim 1 further including a sound module which is operative to store and playback at least one audio file.

4. The greeting card of claim 3, wherein moving the pull tab mechanism from the first position to the second position also causes activation of the sound module and playback of the at least one audio file.

5. The greeting card of claim 1, wherein the at least one flap is located on the front panel of the greeting card body.

6. A greeting card comprising:

a multi-panel greeting card body, a front cover of the multi-panel greeting card body having an opening thereon covered by two flaps;

a pop-out structure contained within the multi-panel greeting card body, the pop-out structure operative to move between a first position wherein it is inside the multi-panel greeting card body and concealed by the two flaps and a second position wherein it is outside of the greeting card body;

a pull tab mechanism which controls movement of the two flaps and the pop-out structure;

wherein pulling on the pull tab mechanism causes the two flaps to open thereby revealing the pop-out structure and also causes the pop-out structure to move between the first and second positions; and wherein pushing the pull tab mechanism back to its original position causes the pop-out structure to move from the second position back to the first position and also causes the flaps to close.

7. The greeting card of claim 6, wherein the two flaps open in opposing directions.

8. The greeting card of claim 6 further comprising a sound module operative to store and playback at least one audio file upon pulling on the pull tab mechanism.

9. The greeting card of claim 6, wherein the pull tab mechanism is partially contained within the multi-panel greeting card body.

10. The greeting card of claim 6, wherein the pull tab mechanism is partially contained outside of the multi-panel greeting card body.

11. The greeting card of claim 6, wherein the pop-out structure comprises a ledge with a small die cut character attached to said ledge.

12. The greeting card of claim 6, wherein the pull tab mechanism is accessible from a top edge of the greeting card.

13. A greeting card comprising:

a greeting card body having an opening on a front surface thereof;

at least one flap which covers the opening on the front surface of the greeting card body;

a pop-out structure contained within the greeting card body beneath the opening on the front surface thereof;

a movement mechanism which causes the pop-out structure to force open the at least one flap on the front surface of the greeting card body and propelling the pop-out structure outside of the greeting card body;

wherein the movement mechanism is also operative to move the pop-out structure from outside of the greeting card to back inside the greeting card.

14. The greeting card of claim 13 further comprising a sound module operative to store and playback at least one audio file.

15. The greeting card of claim 14, wherein the sound module is activated upon the pop-up structure moving outside of the greeting card body.

16. The greeting card of claim 13, wherein two flaps cover the opening on the front surface of the greeting card body.

17. The greeting card of claim 16, wherein the two flaps open in opposing directions.

* * * * *